US010890866B2

(12) United States Patent
Tanaka et al.

(10) Patent No.: US 10,890,866 B2
(45) Date of Patent: Jan. 12, 2021

(54) TRANSFER DEVICE AND IMAGE FORMING APPARATUS

(71) Applicant: FUJI XEROX CO., LTD., Tokyo (JP)

(72) Inventors: Daisuke Tanaka, Kanagawa (JP); Yohei Morita, Kanagawa (JP); Kazuyuki Yagata, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/355,870

(22) Filed: Mar. 18, 2019

(65) Prior Publication Data

US 2020/0096916 A1 Mar. 26, 2020

(30) Foreign Application Priority Data

Sep. 21, 2018 (JP) ..... 2018-176968

(51) Int. Cl.
*G03G 15/16* (2006.01)
*G03G 15/00* (2006.01)

(52) U.S. Cl.
CPC ..... *G03G 15/1685* (2013.01); *G03G 15/607* (2013.01); *G03G 15/6555* (2013.01); *G03G 2215/00721* (2013.01)

(58) Field of Classification Search
CPC ..... G03G 15/1615; G03G 15/161; G03G 15/1675; G03G 15/0163; G03G 15/6555; G03G 15/1685; G03G 15/607; G03G 2215/1661; G03G 2215/1623
See application file for complete search history.

(56) References Cited

U.S. PATENT DOCUMENTS

| | | | | |
|---|---|---|---|---|
| 8,165,498 | B2 | 4/2012 | Hoshino et al. | |
| 8,718,500 | B2 | 5/2014 | Minbu et al. | |
| 2009/0207461 | A1* | 8/2009 | Hodoshima ..... | G03G 15/5029 358/498 |
| 2010/0046991 | A1* | 2/2010 | Hodoshima ..... | G03G 15/1615 399/313 |
| 2012/0121293 | A1* | 5/2012 | Mimbu ..... | G03G 21/1671 399/121 |
| 2014/0294411 | A1* | 10/2014 | Yoshioka ..... | G03G 15/6594 399/45 |

FOREIGN PATENT DOCUMENTS

| | | |
|---|---|---|
| JP | 2009058896 | 3/2009 |
| JP | 2010204259 | 9/2010 |
| JP | 2011186168 | 9/2011 |
| JP | 2013072908 | 4/2013 |
| JP | 2015166772 | 9/2015 |

* cited by examiner

*Primary Examiner* — Walter L Lindsay, Jr.
*Assistant Examiner* — Jessica L Eley
(74) *Attorney, Agent, or Firm* — JCIPRNET

(57) ABSTRACT

A transfer device includes a transfer section that nips a recording medium between the transfer section and an image carrier, which carries an image on a surface thereof, with a variable pressure and that transfers the image on the image carrier to the recording medium; and a transport section that transports the recording medium while the recording medium passes through a transfer region between the image carrier and the transfer section. The transport section transports the recording medium with a first transport ability when the pressure is a first pressure and with a second transport ability that is lower than the first transport ability when the pressure is a second pressure that is higher than the first pressure.

17 Claims, 9 Drawing Sheets

TRANSFER DEVICE AND IMAGE FORMING APPARATUS

CROSS-REFERENCE TO RELATED APPLICATIONS

This application is based on and claims priority under 35 USC 119 from Japanese Patent Application No. 2018-176968 filed Sep. 21, 2018.

BACKGROUND

(i) Technical Field

The present disclosure relates to a transfer device and an image forming apparatus.

(ii) Related Art

A transfer device that nips a sheet (recording medium) in a transfer nip and transfers an image to the sheet is known.

For example, Japanese Unexamined Patent Application Publication No. 2009-058896 discloses a transfer device in which a cam ring separates a nip portion when a recording sheet reaches a predetermined position before being nipped by a second-transfer roller, if the thickness of the recording sheet is larger than a predetermined threshold.

For example, Japanese Unexamined Patent Application Publication No. 2011-186168 discloses a transfer device that separates an image carrying surface and a second-transfer roller from each other before a sheet enters a second-transfer nip and causes the image carrying surface and the second-transfer roller to contact each other via the sheet after the sheet has entered the second-transfer nip.

SUMMARY

Aspects of non-limiting embodiments of the present disclosure relate to suppressing extension/contraction of an image, compared with a case where transport ability is constant.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a transfer device that includes a transfer section that nips a recording medium between the transfer section and an image carrier, which carries an image on a surface thereof, with a variable pressure and that transfers the image on the image carrier to the recording medium; and a transport section that transports the recording medium while the recording medium passes through a transfer region between the image carrier and the transfer section. The transport section transports the recording medium with a first transport ability when the pressure is a first pressure and with a second transport ability that is lower than the first transport ability when the pressure is a second pressure that is higher than the first pressure.

BRIEF DESCRIPTION OF THE DRAWINGS

Exemplary embodiments of the present disclosure will be described in detail based on the following figures, wherein.

DETAILED DESCRIPTION

Exemplary embodiments of the present disclosure will be described with reference to the drawings.

Figure 1:
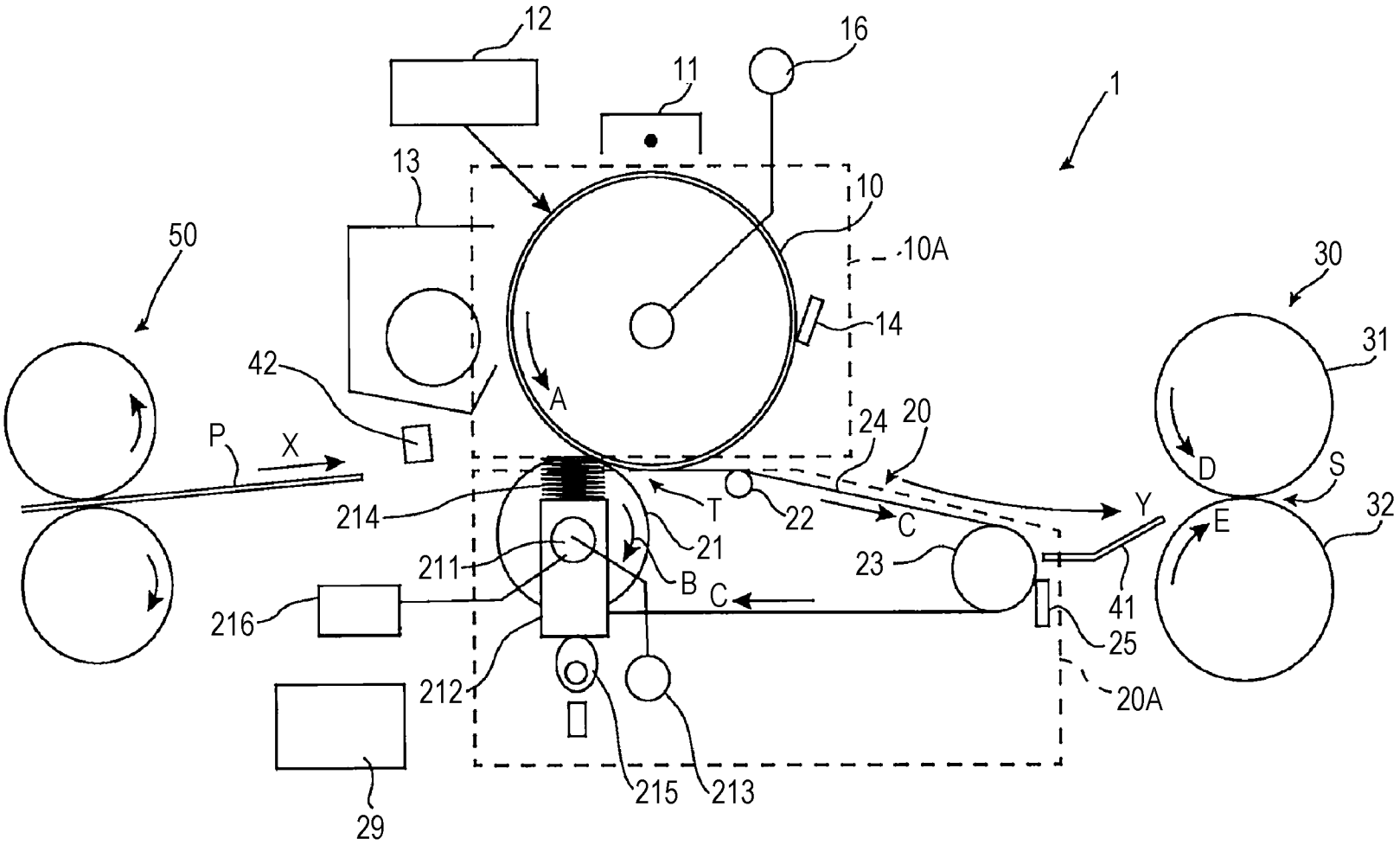
FIG. 1 is a schematic view of an image forming apparatus according to an exemplary embodiment of the present disclosure.

FIG. 1 is a schematic view of an image forming apparatus 1 according to an exemplary embodiment of the present disclosure.

The image forming apparatus 1 is a monochrome printer of a so-called direct-transfer type.

The image forming apparatus 1 includes a photoconductor drum 10. The photoconductor drum 10 is rotatably supported by a drum support frame 10A, is driven by a photoconductor motor 16, and rotates in the direction of an arrow A. The image forming apparatus 1 includes a charging unit 11, an exposure unit 12, and a developing unit 13, which are disposed around the photoconductor drum 10. A toner image is formed on the surface of the photoconductor drum 10 through a process including charging by the charging unit 11, exposure to light by the exposure unit 12, and developing by the developing unit 13. The toner image is carried on the photoconductor drum 10.

In this process, the exposure unit 12 exposes the photoconductor drum 10 to light in accordance with image data sent from the outside of the image forming apparatus 1, and a toner image representing the image data is formed on the photoconductor drum 10. To ensure accuracy of the exposure operation, the photoconductor drum 10 is driven by the photoconductor motor 16 with a stable rotation velocity. To realize the stable rotation velocity, a DC motor is used as the photoconductor motor 16. The photoconductor drum 10 corresponds to an example of an image carrier according to the present disclosure.

A sheet P (a so-called cut sheet), which is an example of a recording medium, is transported by a sheet transport device 50 in the direction of an arrow X and passes through a transfer region T between the photoconductor drum 10 and a transfer device 20 (described below). The sheet transport device 50, which is also called a registration roller, continuously transports the sheet P while the sheet P passes through the transfer region T. The toner image on the photoconductor drum 10 is transferred to the sheet P while the sheet P passes through the transfer region T. The image forming apparatus 1 according to the present exemplary embodiment is capable forming an image on a plurality of types of sheets P. It is assumed that information on the size and thickness of a sheet P supplied to the image forming apparatus 1 is input beforehand by using an input operation unit (not shown).

A sheet-end detection sensor 42 detects an end portion of a sheet P transported to the transfer region T. For example, the sheet-end detection sensor 42 is an optical sensor or a contact sensor that detects passage of a leading end and passage of a trailing end of the sheet P. The sheet-end detection sensor 42 corresponds to an example of a detection section according to the present disclosure.

A cleaner 14 removes residual toner, which is toner that remains on the photoconductor drum 10 after the toner image has been transferred in the transfer region T, from the photoconductor drum 10.

The sheet P, to which the toner image has been transferred in the transfer region T, is further transported in the direction of an arrow Y and fed into a fixing device 30. The fixing device 30 includes a heating roller 31, which rotates in the direction of an arrow D, and a pressing roller 32, which rotates in the direction of an arrow E. The heating roller 31 and the pressing roller 32 are in contact with each other and form a fixing region S. The sheet P, which has moved in the direction of the arrow Y, enters the fixing region S. While the sheet P passes through the fixing region S, the toner image on the sheet P is heated and pressed, and the toner image is fixed onto the sheet P. As a result of the fixing operation, an image, which is a fixed toner image, is formed on the sheet P. A sheet output device (now shown) outputs the sheet P, on which the image has been formed, to the outside of the image forming apparatus 1.

The transfer device 20 corresponds to an example of a transfer section according to the present disclosure. The transfer device 20 includes a transfer roller 21, a press-contact roller 22, a peel-off roller 23, and a transfer belt 24. The transfer belt 24 is an endless belt that is looped over the rollers 21 to 23. The transfer roller 21, the press-contact roller 22, and the peel-off roller 23 are rotatably supported by a transfer-device support frame 20A.

The transfer roller 21 is driven by a transfer motor 213, rotates in the direction of an arrow B, and drives the transfer belt 24. The transfer motor 213 is also a DC motor, and the transfer roller 21 is driven by the transfer motor 213 with a stable rotation velocity. The transfer belt 24, which is a resin belt whose elasticity is low, circulates in the direction of an arrow C by receiving a driving force from the transfer roller 21. With the transfer roller 21 and the transfer belt 24, the transfer device 20 serves to transport the sheet P while the sheet P passes through the transfer region T. A combination of parts of the transfer device 20 that have such a transport function and the sheet transport device 50 described above correspond to an example of a transport section according to the present disclosure.

The transfer roller 21 is located upstream, in the sheet transport direction, of the rotation axis of the photoconductor drum 10. The transfer roller 21 presses the transfer belt 24 against the photoconductor drum 10 from the inside of the transfer belt 24. The transfer roller 21 defines the upstream edge of the transfer region T, in which the photoconductor drum 10 and the transfer belt 24 contact each other.

The press-contact roller 22 is located downstream, in the sheet transport direction, of the rotation axis of the photoconductor drum 10. The press-contact roller 22 presses the transfer belt 24 upward toward the photoconductor drum 10 from the inside of the transfer belt 24. The press-contact roller 22 defines the downstream edge of transfer region T.

The peel-off roller 23 is a roller whose diameter is smaller than that of the transfer roller 21. The peel-off roller 23 sharply changes the direction in which the transfer belt 24 moves, thereby peeling off a leading end of the sheet P, which is placed on the transfer belt 24, from the transfer belt 24. The sheet P, which is peeled off from the transfer belt 24, is guided by a guide member 41 in the direction of an arrow Y, and the sheet P is fed to the fixing device 30 as described above.

The transfer device 20 includes a cleaner 25. The cleaner 25 removes toner and other unwanted substances, which adhere to the transfer belt 24, from the transfer belt 24.

The transfer roller 21 includes a rotation shaft 211, and the rotation shaft 211 is rotatably supported by a shaft support frame 212. The shaft support frame 212 is supported by the transfer-device support frame 20A, which supports the entirety of the transfer device 20, in such a way that the shaft support frame 212 is vertically movable.

The rotation shaft 211 of the transfer roller 21 is connected to a power supply 216, and the power supply 216 applies a transfer bias to the transfer roller 21. While the sheet P passes through the transfer region T, a toner image on the photoconductor drum 10 is transferred onto the sheet P due to the action of the transfer bias.

A pressing spring 214, which urges the shaft support frame 212 in a direction away from the drum support frame 10A, is disposed between the shaft support frame 212 and the drum support frame 10A. The transfer device 20 includes an eccentric cam 215, whose rotation shaft is rotatably supported by the transfer-device support frame 20A.

The eccentric cam 215 stops the shaft support frame 212 against the urging force of the pressing spring 214. The position of the shaft support frame 212 is changed due to rotation of the eccentric cam 215. FIG. 1 illustrates a pressing state in which the shaft support frame 212 is pushed by the eccentric cam 215 and thereby the transfer roller 21 presses the transfer belt 24 against the photoconductor drum 10. When the eccentric cam 215 rotates by a half turn around the rotation shaft from the state illustrated in FIG. 1, the shaft support frame 212 is pushed by the urging force of the pressing spring 214 in the downward direction in FIG. 1, and the transfer roller 21 and the transfer belt 24 enter a separation state in which the transfer roller 21 and the transfer belt 24 are separated from the photoconductor drum 10.

That is, due to the rotation of the eccentric cam 215, the relative distance of the transfer roller 21 and the transfer belt 24 with respect to the photoconductor drum 10 is changed. Due to the change in the relative distance, a nip load (nip pressure), which is a load with which the sheet P is nipped between the photoconductor drum 10 and the transfer belt 24 in the transfer region T, changes.

It may be possible to change the relative distance of the transfer roller 21 and the transfer belt 24 with respect to the photoconductor drum 10 by moving the photoconductor drum 10. However, in consideration of the difference in complexity of the surrounding structure, it is practical to move the transfer roller 21 and the transfer belt 24 relative to the photoconductor drum 10.

The transfer device 20 includes a controller 29, which is an information processor that includes a CPU as an arithmetic element and a RAM and a ROM as memories. The controller 29 controls rotation of the eccentric cam 215, driving of the transfer motor 213, and the transfer bias of the power supply 216.

When the leading end of the sheet P enters the transfer region T, the photoconductor drum 10 may be vibrated in the rotation direction due to the impact of the entry. In order to reduce the impact, the nip load (nip pressure) is controlled as described below in the present exemplary embodiment.

Figure 2:
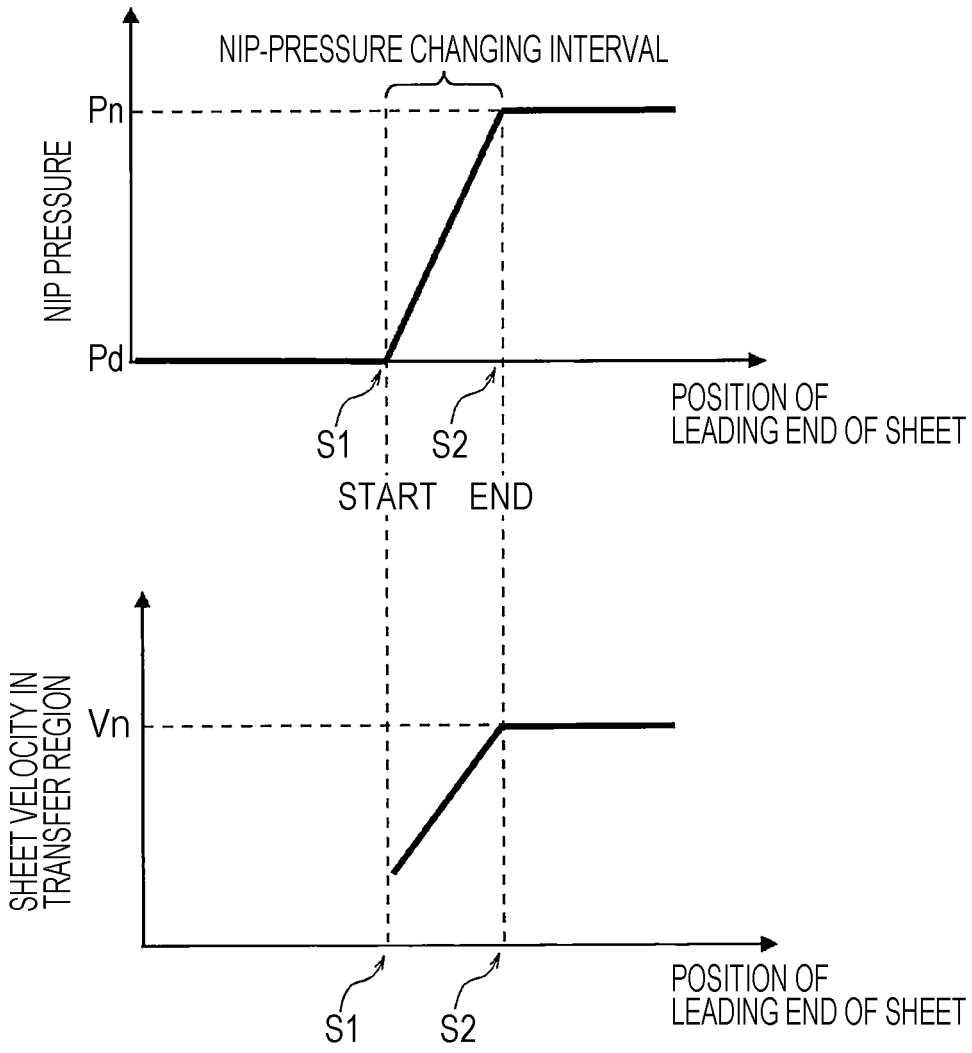
FIG. 2 illustrates control of a nip load (nip pressure) that is performed when a leading end of a sheet enters a transfer region.

FIG. 2 illustrates control of the nip load (nip pressure) that is performed when the leading end of the sheet P enters the transfer region T.

The upper part of FIG. 2 is a graph of the nip load (nip pressure) when the leading end of the sheet P enters the transfer region T. The lower part of FIG. 2 is a graph of the velocity with which the sheet P passes through the transfer region T. In each of the graphs, the horizontal axis represents the position of the leading end of the sheet P.

Before the leading end of the sheet P reaches an entry position S1 in the transfer region T, the nip load (nip pressure) is on standby at a low nip pressure Pd (for example, zero nip pressure), which is lower than a normal (nominal) nip pressure Pn. Thus, the impact of entry of the leading end of the sheet P into the transfer region T is reduced. After the leading end of the sheet P has entered the transfer region T, the nip load (nip pressure) is increased toward the normal nip pressure Pn. The nip load (nip pressure) reaches the normal nip pressure Pn when the leading end of the sheet P reaches a nip-change end position S2.

By controlling the nip pressure in this way, the impact of entry of the leading end of the sheet P is reduced. However, because the sheet P is transported by the transfer roller 21 and the transfer belt 24 of the transfer device 20, as illustrated in the lower part of FIG. 2, the passing velocity of the sheet P may change due to change in nip pressure.

That is, when the nip pressure is the low nip pressure Pd lower than the normal nip pressure Pn, the transport force of the transfer device 20 for transporting the sheet P is small, because friction between the transfer belt 24 of the transfer device 20 and the sheet P is smaller than that in a normal (nominal) state. Therefore, if no measures were taken, a velocity with which the sheet P passes through the transfer region T would be lower than a passing velocity Vn in the normal (nominal) state in which the nip pressure is the low nip pressure Pd. Then, as the nip pressure increases toward the normal nip pressure Pn, the velocity with which the sheet P passes through the transfer region T increases toward the passing velocity Vn in the normal (nominal) state.

Such change in velocity causes extension/contraction of an image, which is transferred in the transfer region T, in the transport direction.

Figure 3:
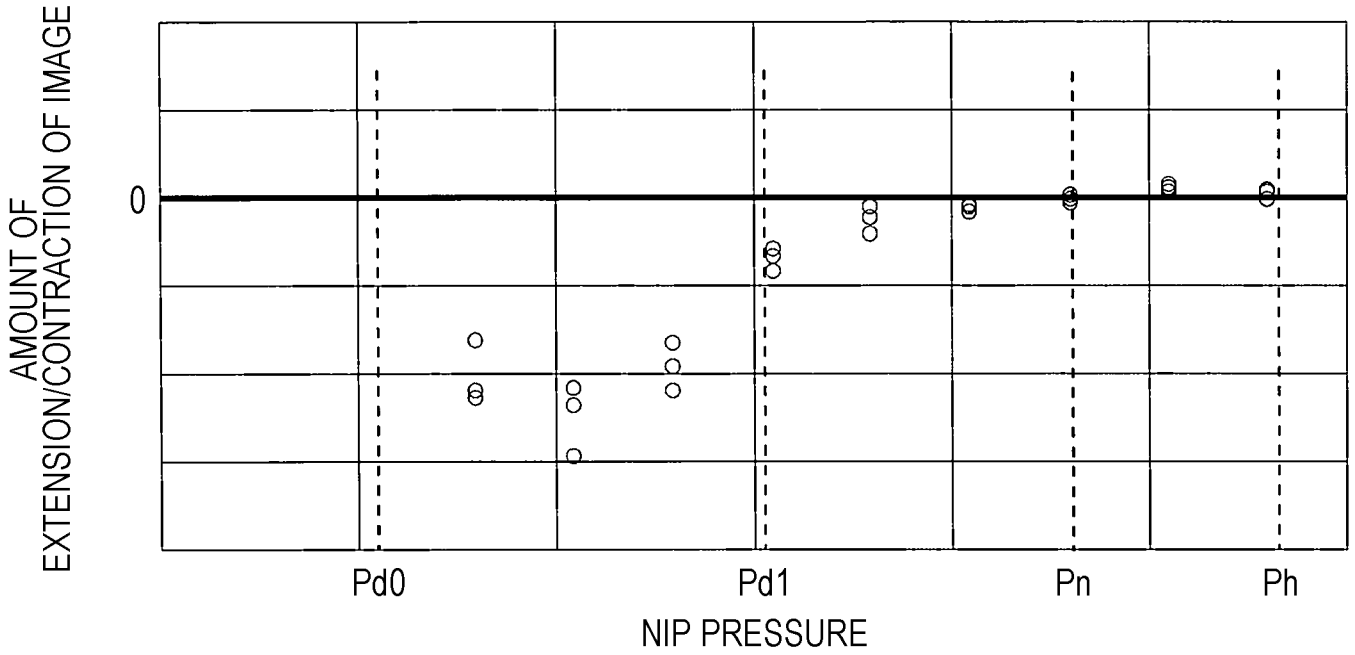
FIG. 3 illustrates the relationship between a nip pressure and extension/contraction of an image.

FIG. 3 illustrates the relationship between the nip pressure and the amount of extension/contraction of an image.

In FIG. 3, the horizontal axis represents the nip pressure, and the vertical axis represents the amount of extension/contraction of an image.

In FIG. 3, the following examples of a nip pressure are shown: a zero nip pressure Pd0; a low nip pressure Pd1 for, for example, a thin sheet; the normal nip pressure Pn; and a high nip pressure Ph for, for example, a thick sheet. In FIG. 3, measurements of the amount of extension/contraction of an image are shown by blank circles. It can be seen that measurements for the zero nip pressure Pd0 and the low nip pressure Pd1 are separated from a zero-extension/contraction-amount line. Moreover, it can be seen that the measurements become closer to the zero-extension/contraction-amount line as the nip pressure becomes closer to the normal nip pressure Pn, and that the measurements are located near the zero-extension/contraction-amount line also when the nip pressure reaches the high nip pressure Ph.

Such extension/contraction of an image may occur due to change in nip pressure, irrespective of the position of the sheet P.

The present exemplary embodiment has measures for suppressing the extension/contraction of an image due to change in nip pressure.

Figure 4:
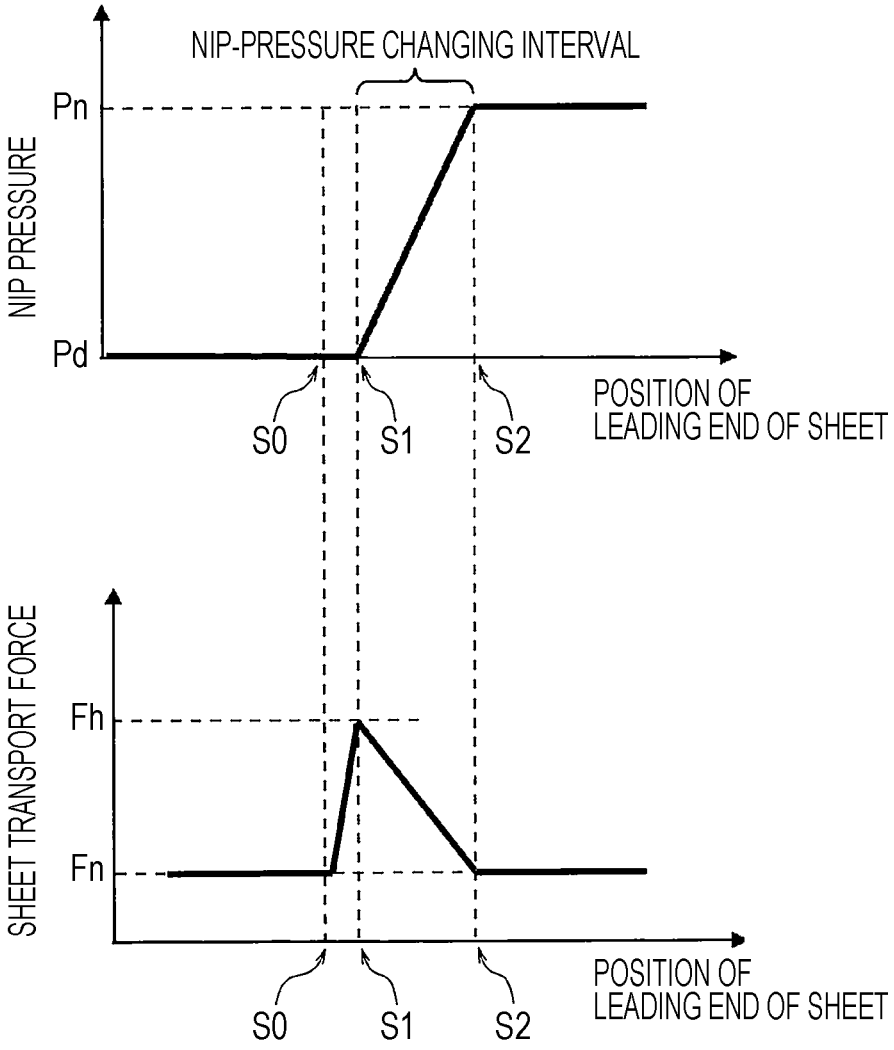
FIG. 4 is a conceptual diagram illustrating measures for suppressing the extension/contraction of an image due to change in nip pressure.

FIG. 4 is a conceptual diagram illustrating the measures for suppressing the extraction/contraction of an image due to change in nip pressure.

The image forming apparatus 1 according to the present exemplary embodiment changes a sheet transport force, which is the sum of the transport ability of the sheet transport device 50 in transporting the sheet P and the transport ability of the transfer device 20 in transporting the sheet P, in accordance with change in nip pressure.

The upper part of FIG. 4 is a graph of the nip pressure, which is also shown in FIG. 2. The lower part of FIG. 4 is a graph of the sheet transport force. In each of the graphs, the horizontal axis represents the position of the leading end of the sheet P.

Before the leading end of the sheet P reaches the position S0 of the sheet-end detection sensor 42 and is detected, the sheet transport force is on standby at a normal transport force Fn, which is a sheet transport force for a normal state. When the leading end of the sheet P is detected by the sheet-end detection sensor 42, the sheet transport force is increased to a high transport force Fh, which is higher than the normal transport force Fn. Specific methods of increasing the sheet transport force will be described below. The sheet transport force is increased to a level such that the sheet transport force offsets the decrease of the passing velocity of the sheet P due to the low nip pressure Pd and a passing velocity that is substantially the same as the normal passing velocity is obtained.

Increase of the sheet transport force to the high transport force Fh is complete before the leading end of the sheet P reaches the entry position S1 in the transfer region T. When the leading end of the sheet P reaches the entry position S1, the sheet transport force decreases toward the normal transport force Fn as the nip pressure increases. When the leading end of the sheet P reaches the nip-change end position S2, the sheet transport force has reached the normal transport force Fn. Because the sheet transport force is increased and decreased in this way, change in the passing velocity of the sheet P due to change in the nip pressure is further suppressed and the extension/contraction of an image is also suppressed.

In this example, the change in nip pressure occurs when the leading end of the sheet P enters the transfer region T. However, the nip pressure may be changed for other purposes. Also when the nip pressure changes for other purposes, extension/contraction of an image is suppressed by changing the sheet transport force in accordance with the change in nip pressure as illustrated in FIG. 4.

In this example, the sheet transport force is changed with a timing at which the sheet-end detection sensor 42 detects the leading end of the sheet P. Therefore, timing adjustment is performed with a simple structure. However, changing of the sheet transport force may be performed, for example, based on a timing at which the sheet transport device 50 (registration roller) feeds the sheet P into the transfer region T.

In this example, the sheet transport force continuously changes over time. However, a method of changing the sheet transport force is not limited to this.

Figure 5:
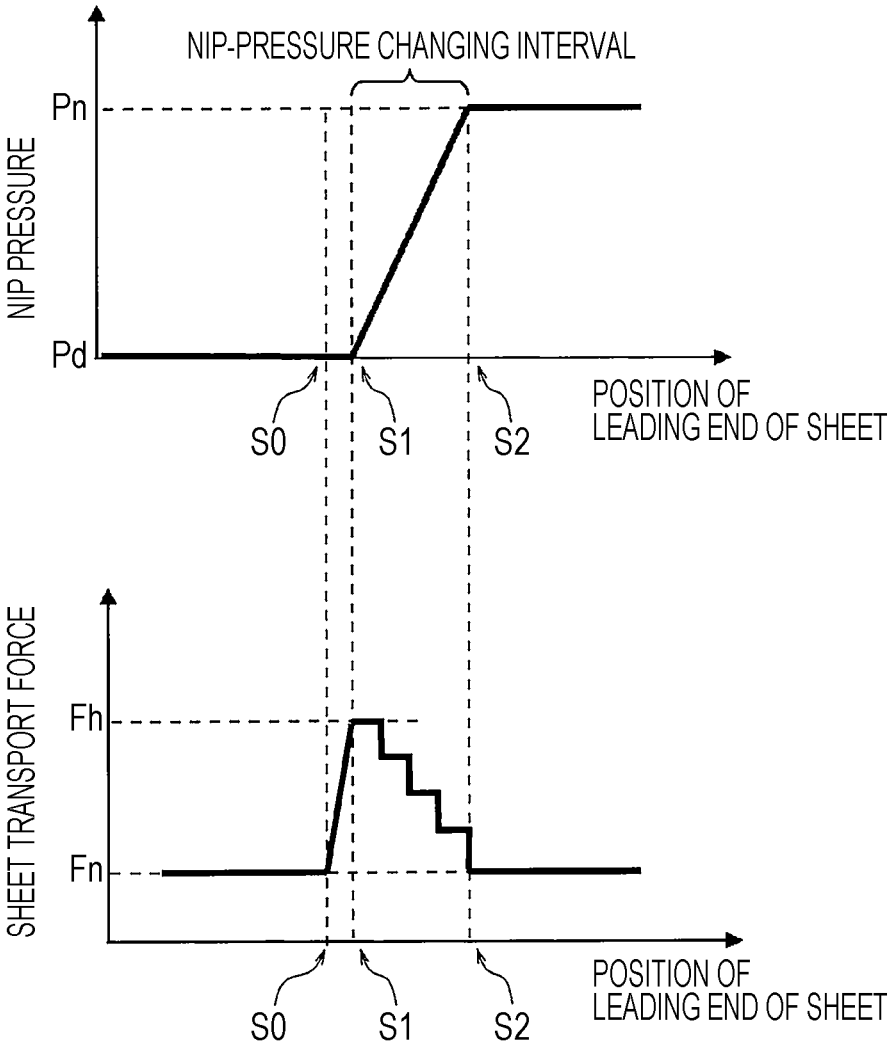
FIG. 5 illustrates another example of a method of changing a sheet transport force.

FIG. 5 illustrates another example of a method of changing the sheet transport force.

The upper part of FIG. 5 is a graph of the nip pressure. The lower part of FIG. 5 is a graph of the sheet transport force. In each of the graphs, the horizontal axis represents the position of the leading end of the sheet P.

In the example illustrated in FIG. 5, the sheet transport force changes in a stepwise manner over time. That is, when the leading end of the sheet P reaches the position S0 in the sheet-end detection sensor 42, the sheet transport force is increased to the high transport force Fh, which is higher than the normal transport force Fn. When the leading end of the sheet P reaches the entry position S1, the sheet transport force decreases in a stepwise manner to the normal transport force as the leading end of the sheet P advances. The extension/contraction of an image described above is suppressed by changing the sheet transport force in such a stepwise manner.

Figure 6:
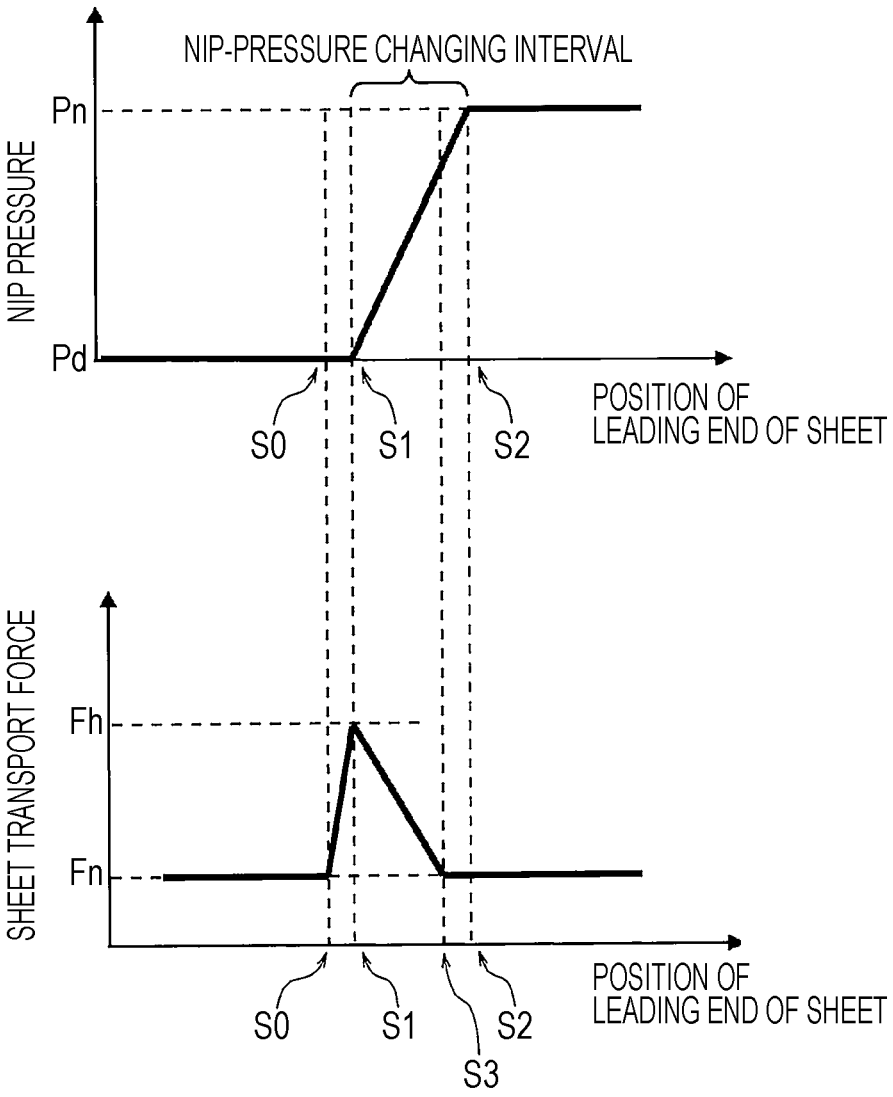
FIG. 6 illustrates still another example of a method of changing the sheet transport force.

FIG. 6 illustrates still another example of a method of changing the sheet transport force.

Decrease of the sheet transport force from the high transport force Fh to the normal transport force Fn may be finished at a position upstream of the nip-change end position S2. In the example illustrated in FIG. 6, the sheet transport force has decreased to the normal transport force Fn when the leading end of the sheet P reaches a position S3 upstream of the nip-change end position S2. Although the nip pressure has not reached the normal nip pressure Pn at this time, as can be seen from the measurements of extension/contraction of an image shown in FIG. 3, the extension/contraction of an image becomes substantially zero at a nip pressure slightly lower than the normal nip pressure Pn. Therefore, it is considered that extension/contraction of an image does not occur even if the sheet P is transported with the normal transport force Fn when the leading end of the sheet P reaches the position S3, at which the nip pressure is supposed to have reached a pressure slightly lower than the normal nip pressure Pn. Accordingly, after passing the position S3, it is desirable that the sheet P be transported with the normal transport force Fn without using an excessive sheet transport force.

Next, specific methods for increasing the sheet transport force will be described.

In the following, specific examples of the method of increasing the sheet transport force illustrated in FIG. 4 will be described. However, these examples are also applicable to the methods of increasing the sheet transport force illustrated in FIGS. 5 and 6.

Figure 7:
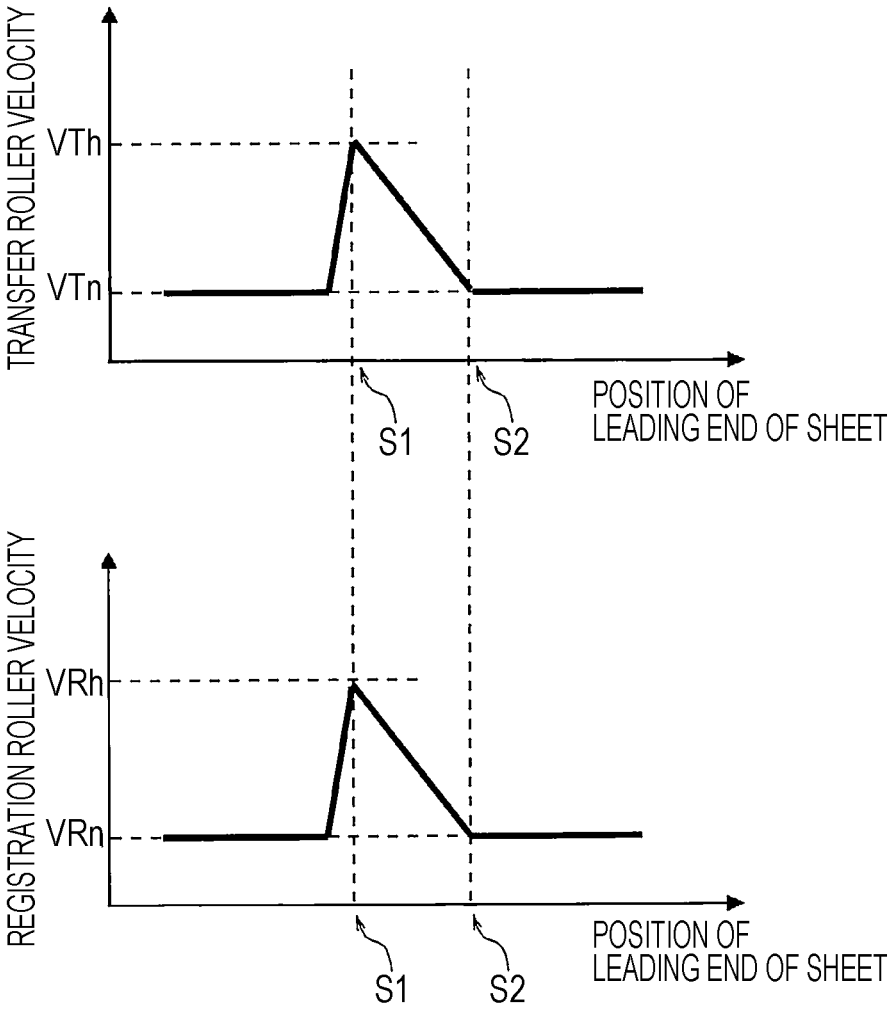
FIG. 7 illustrates a first specific method of increasing the sheet transport force.

FIG. 7 illustrates a first specific method of increasing the sheet transport force.

As described above, the sheet transport device 50 (registration roller) and the transfer device 20 contribute to the sheet transport force. The sheet transport force of the registration roller depends on the rotation velocity of the registration roller. That is, as the rotation velocity of the registration roller increases, a force that pushes the sheet into the transfer region T increases, and the sheet transport force increases.

The sheet transport force of the transfer device 20 depends on the rotation velocities of the transfer belt 24 and the transfer roller 21 and the nip pressure. The rotation velocity of the transfer roller 21, which is driven by the transfer motor 213, is a factor that allows the sheet transport force to increase and decrease independently from the nip pressure. That is, in the transfer region T, the sheet P moves while adhering to the photoconductor drum 10 due to the action of the transfer bias. As the rotation velocity of the transfer roller 21 increases, the movement velocity of the transfer belt 24 increases, a force that moves the sheet P adhering to the photoconductor drum 10 increases, and therefore the sheet transport force increases.

The upper part of FIG. 7 is a graph of the rotation velocity of the transfer roller 21. The lower part of FIG. 7 is a graph of the rotation velocity of the registration roller. In each of the graphs, the horizontal axis represents the position of the leading end of the sheet P.

In the example illustrated in FIG. 7, when the leading end of the sheet P reaches the entry position S1 in the transfer region T, the rotation velocity of the transfer roller 21 has increased to a high velocity VTh, which is higher than a normal velocity VTn, and the rotation velocity of the registration roller has increased to a high velocity VRh, which is higher than a normal velocity VRn. That is, in the example illustrated in FIG. 7, the sheet transport device 50 (registration roller) and the transfer device 20 increase the sheet transport force in cooperation with each other.

Increasing the sheet transport force by using the transfer device 20, which directly acts on the sheet P in the transfer region T, is desirable because the velocity of the sheet P is directly adjusted.

In contrast to the transfer device 20, which serves to transport the sheet and to transfer an image, the sheet transport device 50 (registration roller) serves only to transport the sheet. Therefore, increasing the sheet transport force by using the sheet transport device 50 is desirable because the action is separated from image transfer.

Figure 8:
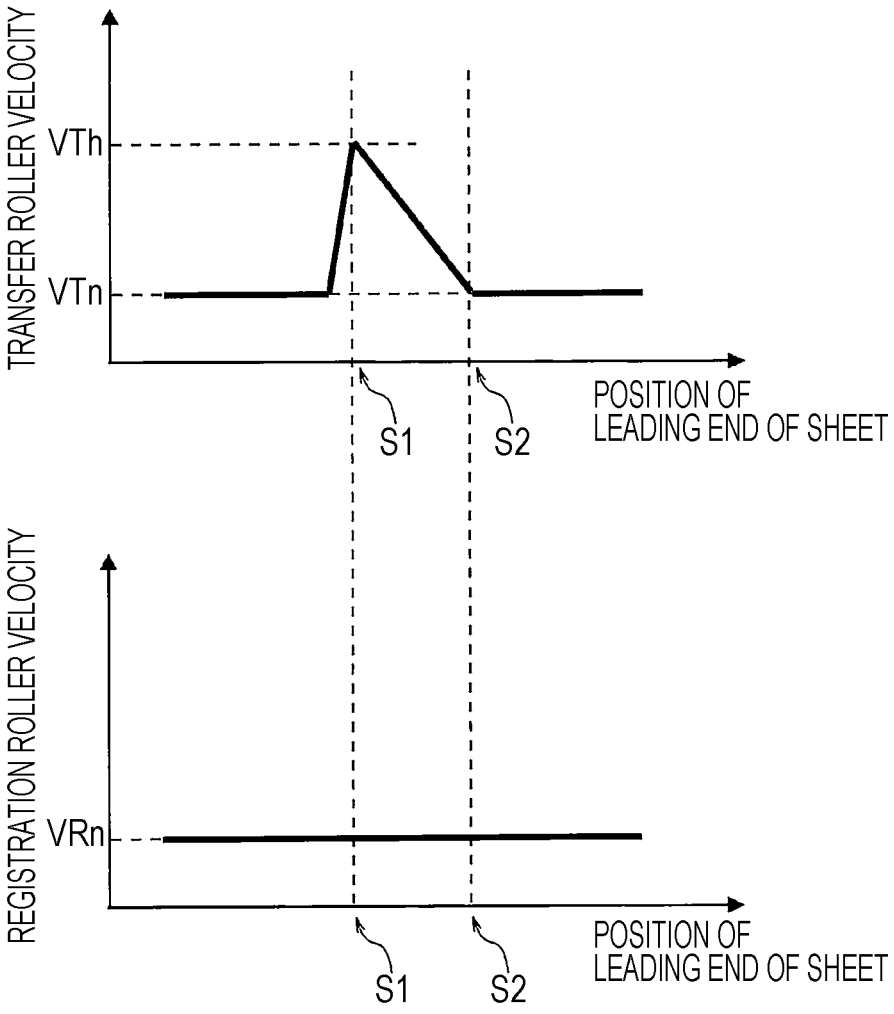
FIG. 8 illustrates a second specific method of increasing the sheet transport force.

FIG. 8 illustrates a second specific method of increasing the sheet transport force.

The upper part of FIG. 8 is a graph of the rotation velocity of the transfer roller 21. The lower part of FIG. 8 is a graph of the rotation velocity of the registration roller. In each of the graphs, the horizontal axis represents the position of the leading end of the sheet P.

In the example illustrated in FIG. 8, when the leading end of the sheet P reaches the entry position S1 in the transfer region T, the rotation velocity of the transfer roller 21 has increased to the high velocity VTh, which is higher than the normal velocity VTn, whereas the rotation velocity of the registration roller is continuously maintained at the normal velocity VRn also in a period while the leading end of the sheet P moves from the entry position S1 to the nip-change end position S2. That is, in the example illustrated in FIG. 8, the sheet transport force is increased only by increasing the rotation velocity of the transfer device 20.

Figure 9:
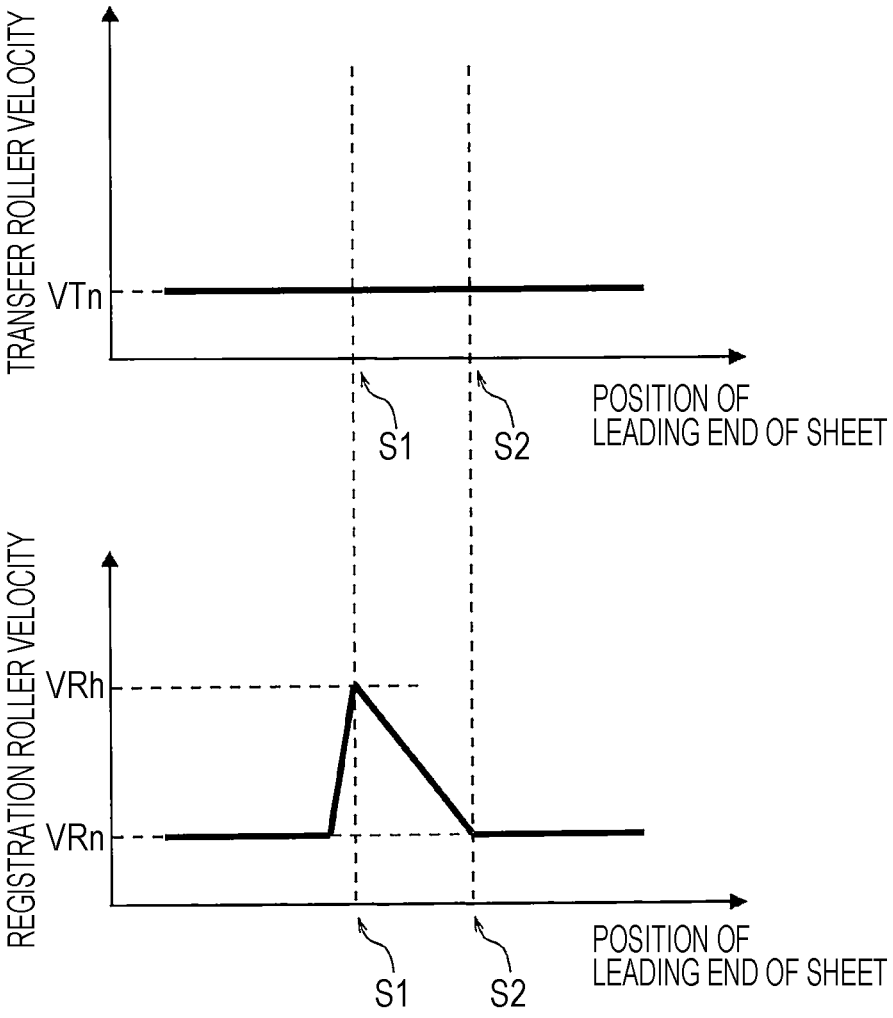
FIG. 9 illustrates a third specific method of increasing the sheet transport force.

FIG. 9 illustrates a third specific method of increasing the sheet transport force.

The upper part of FIG. 9 is a graph of the rotation velocity of the transfer roller 21. The lower part of FIG. 9 is a graph of the rotation velocity of the registration roller. In each of the graphs, the horizontal axis represents the position of the leading end of the sheet P.

In the example illustrated in FIG. 9, when the leading end of the sheet P reaches the entry position S1 in the transfer region T, the rotation velocity of the registration roller has increased to the high velocity VRh, which is higher than the normal velocity VRn, whereas the rotation velocity of the transfer roller 21 is continuously maintained at the normal velocity VTn also in a period while the leading end of the sheet P moves from the entry position S1 to the nip-change end position S2. That is, in the example illustrated in FIG. 9, the sheet transport force is increased only by increasing the velocity of the sheet transport device 50 (registration roller).

As illustrated in FIGS. 8 and 9, increase of the sheet transport force can be realized by using only one of the transfer device 20 and the sheet transport device 50 (registration roller). Regarding change in nip pressure that occurs at a time excluding the time when the leading end of the sheet P enters the transfer region T, for example, extension/contraction of an image may be suppressed by adjusting the sheet transport force by performing velocity adjustment in the fixing device 30.

In the above description, a direct-transfer monochrome printer is used as an example. However, an image forming apparatus according to the present disclosure may be an indirect-transfer printer or may be a color printer. In a case where the image forming apparatus is an indirect-transfer printer, an intermediate transfer belt corresponds to an image carrier according to the present disclosure.

In the above the description, an electrophotographic printer is used as an example. However, an image forming apparatus according to the present disclosure may be a printer that forms a toner image by using a method other than the electrophotographic method; or may be a copier, a facsimile machine, or a multifunctional machine.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A transfer device comprising:

a transfer section that nips a recording medium between the transfer section and an image carrier, which carries an image on a surface thereof, with a variable pressure and that transfers the image on the image carrier to the recording medium; and a transport section that transports the recording medium while the recording medium passes through a transfer region between the image carrier and the transfer section, the transport section transporting the recording medium with a first transport ability when the pressure is a first pressure and with a second transport ability that is lower than the first transport ability when the pressure is a second pressure that is higher than the first pressure, wherein the transfer section nips the recording medium with the first pressure when a leading end of the recording medium reaches the transfer region, and the transfer section changes the pressure, for nipping the recording medium, to the second pressure as the leading end leaves the transfer region.

2. The transfer device according to claim 1, wherein the transport section at least includes, as an element thereof, a part of the transport section whose surface circulates and that transports the recording medium.

3. The transfer device according to claim 2, wherein the transport section includes, as an element thereof, a feeding unit that feeds the recording medium from the outside of the transfer region to the transfer region.

4. The transfer device according to claim 3, wherein the transport section reduces transport ability from the first transport ability to the second transport ability over time while the pressure increases from the first pressure to the second pressure.

5. The transfer device according to claim 4, wherein the transport section reduces the transport ability to the second transport ability before the pressure reaches the second pressure.

6. The transfer device according to claim 2, wherein the transport section reduces transport ability from the first transport ability to the second transport ability over time while the pressure increases from the first pressure to the second pressure.

7. The transfer device according to claim 6, wherein the transport section reduces the transport ability to the second transport ability before the pressure reaches the second pressure.

8. The transfer device according to claim 1, wherein the transport section includes, as an element thereof, a feeding unit that feeds the recording medium from the outside of the transfer region to the transfer region.

9. The transfer device according to claim 8, wherein the transport section reduces transport ability from the first transport ability to the second transport ability over time while the pressure increases from the first pressure to the second pressure.

10. The transfer device according to claim 9, wherein the transport section reduces the transport ability to the second transport ability before the pressure reaches the second pressure.

11. The transfer device according to claim 1, wherein the transport section reduces transport ability from the first transport ability to the second transport ability over time while the pressure increases from the first pressure to the second pressure.

12. The transfer device according to claim 11, wherein the transport section reduces the transport ability to the second transport ability before the pressure reaches the second pressure.

13. The transfer device according to claim 1, wherein, when the leading end of the recording medium reaches the transfer region, the transport section transports the recording medium with the first transport ability that is highest in a period during which an entirety of the recording medium, including the leading end and a trailing end, passes through the transfer region.

14. The transfer device according to claim 13, further comprising:

a detection section that detects the leading end of the recording medium moving toward the transfer region, wherein, before detection of the leading end by the detection section, the transport section stands by at a transport ability that is lower than the first transport ability, and, in response to detection of the leading end by the detection section, the transport section increases the transport ability to the first transport ability before the leading end reaches the transfer region.

15. The transfer device according to claim 1, further comprising:

a detection section that detects the leading end of the recording medium moving toward the transfer region, wherein, before detection of the leading end by the detection section, the transport section stands by at a transport ability that is lower than the first transport ability, and, in response to detection of the leading end by the detection section, the transport section increases the transport ability to the first transport ability before the leading end reaches the transfer region.

16. The transfer device according to claim 1, wherein the first transport ability is a first transport force and the second transport ability is a second transport force.

17. An image forming apparatus comprising:

an image carrier that carries an image on a surface thereof;

an image forming section that forms the image on the image carrier;

a transfer section that nips a recording medium between the transfer section and the image carrier with a variable pressure and that transfers the image on the image carrier to the recording medium; and a transport section that transports the recording medium while the recording medium passes through a transfer region between the image carrier and the transfer section, the transport section transporting the recording medium with a first transport ability when the pressure is a first pressure and with a second transport ability that is lower than the first transport ability when the pressure is a second pressure that is higher than the first pressure, wherein the transfer section nips the recording medium with the first pressure when a leading end of the recording medium reaches the transfer region, and the transfer section changes the pressure, for nipping the recording medium, to the second pressure as the leading end leaves the transfer region.

* * * * *